United States Patent [19]

Bedell et al.

[11] Patent Number: 4,563,390

[45] Date of Patent: Jan. 7, 1986

[54] FABRICATED TOY ANIMAL WHISKER CONSTRUCTION AND METHODS AND APPARATUS FOR PRODUCING AND APPLYING SAME

[75] Inventors: Richard L. Bedell, 27 Pine St., Dover, Mass. 02030; Joseph J. Bushee, Watertown, Mass.

[73] Assignee: Richard Lund Bedell, Dover, Mass.

[21] Appl. No.: 731,324

[22] Filed: May 3, 1985

Related U.S. Application Data

[63] Continuation of Ser. No. 466,127, Feb. 14, 1983, abandoned.

[51] Int. Cl.[4] ..... B32B 5/16; D02G 3/00

[52] U.S. Cl. ..... 428/357; 428/359; 428/364; 428/397; 428/15; 446/394

[58] Field of Search ..... 428/192, 357, 397, 399, 428/400, 359, 364, 15; 446/394, 391, 392, 393, 395

[56] References Cited

U.S. PATENT DOCUMENTS

| | | | |
|---|---|---|---|
| 2,303,800 | 8/1940 | Swann . | |
| 2,672,640 | 3/1954 | Peterson . | |
| 3,238,553 | 3/1966 | Bailey et al. | 428/397 X |
| 3,256,545 | 6/1966 | Lewis et al. | 428/399 X |
| 3,256,597 | 4/1962 | Brudney . | |
| 3,325,845 | 6/1967 | Sawkiw | 428/400 X |
| 3,402,416 | 9/1968 | Shaw et al. | 428/399 X |
| 4,348,060 | 9/1982 | Lewis, Jr. . | |
| 4,381,325 | 4/1983 | Masuda et al. | 428/400 X |

OTHER PUBLICATIONS

Dennison brochure for Swiftach Systems, 1978.

*Primary Examiner*—Lorraine T. Kendell

*Attorney, Agent, or Firm*—Hamilton, Brook, Smith & Reynolds

[57] ABSTRACT

Filaments of flexible material are gathered into bundles of a desired number of filaments. Filaments in each bundle are thereafter secured together by anchor barbs which are molded therearound and which present pointed end portions. Simultaneously molded web portions are formed in a position to connect together a desired number of bundles in spaced apart relationship. Filaments in each of the connected bundles are cut to a required length and comprise a web clip of anchor barbs and filaments. The web clip of anchor barbs may then be received in an injector mechanism for cutting successive anchor barbs from the clip and injecting severed barbs into a covering material such as a fabric. The injection mechanism may be an injector head into which the clips of anchor barbs may be fed. It may also be desired to employ a manually operated injector gun. The injector gun is pneumatically powered to cut off and drive individual anchor barbs through a covering material such as the nose portion of a toy animal of the teddy bear. There may thus be produced depending sets of filaments which are solidly anchored in the covering material to constitute sets of artificial whiskers.

10 Claims, 46 Drawing Figures

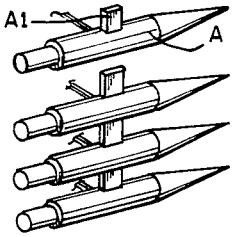
Fig. 26A
Fig. 27
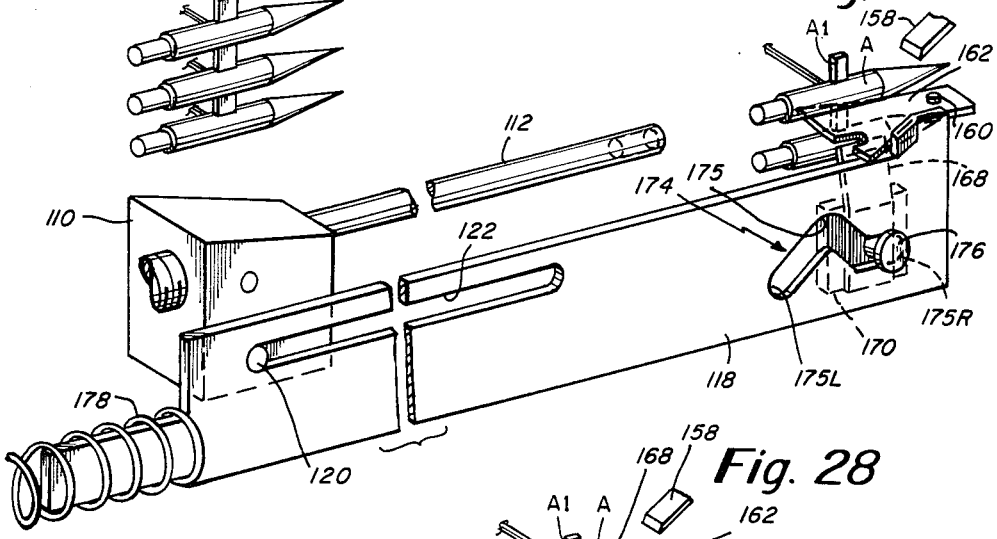
Fig. 28
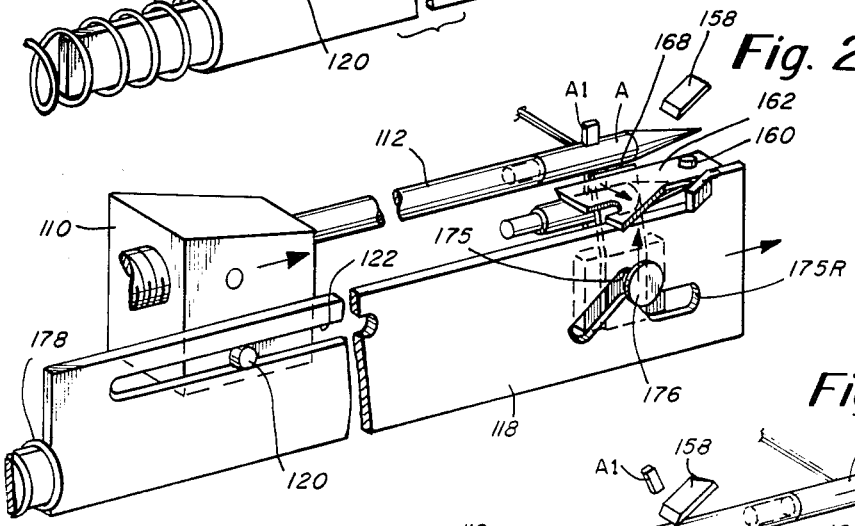
Fig. 29
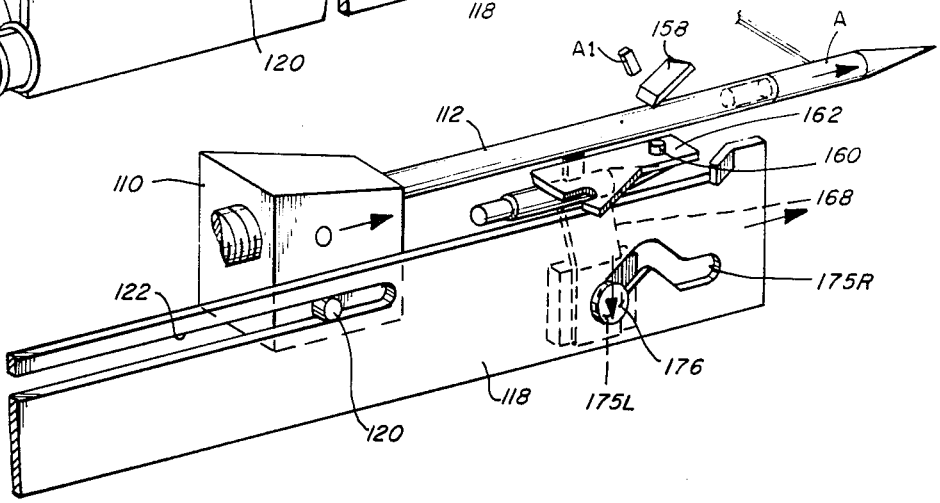

FABRICATED TOY ANIMAL WHISKER CONSTRUCTION AND METHODS AND APPARATUS FOR PRODUCING AND APPLYING SAME

This is a continuation of U.S. patent application Ser. No. 466,127, filed Feb. 14, 1983, now abandoned.

FIELD OF THE INVENTION

The concept of attaching filament assemblies or bundles in anchored relationship in a covering material such as a fabric body has originated in dealing with problems arising in making toy animals. The manufacture of toy animals such as toy teddy bears and similar toy animals is carried out extensively by a considerable number of manufacturing companies, and in the trade a highly important factor is the cost of preparing and assembling the materials from which the toy animals are made. This is particularly the case in providing and applying animal whiskers for a toy animal such as a teddy bear. At the present time the practice in the trade is to provide and attach whisker components by hand, a procedure which is time consuming and expensive and adds materially to the cost of manufacture.

Because of this situation there exists a need for more efficient methods of forming and attaching animal whisker components and in particular apparatus which can eliminate the need for manual operation so as to allow material saving in manufacturing costs.

BRIEF DESCRIPTION OF THE DRAWINGS

FIG. 26A is a detail perspective view.

FIG. 27 is a perspective view illustrating slide bar and injection rod components of the injector gun and a top anchor barb in a position to be trimmed and ejected.

FIG. 28 is another perspective view showing the anchor barb trimmed and being advanced.

FIG. 29 is another perspective view of the injector components showing a change in position of the shoulder pin in the slide bar groove.

SUMMARY OF THE INVENTION

This invention relates to filament assemblies for attachment to a covering material such as a textile body. More particularly the invention is concerned with a filament assembly which may function as a fabricated toy animal whisker construction and the invention is further concerned with improved apparatus and methods for producing and applying filament assemblies particularly with respect to a toy teddy bear.

It is a chief object of the invention, therefore, to provide an improved fabricated filament assembly and especially a filament construction which is suited to functioning as a fabricated toy animal whisker component.

It is a further object of the invention to devise an improved method and apparatus for producing filament assemblies particularly in a construction suitable for functioning as a fabricated toy animal whisker.

Still another object is to devise a method and an injection gun means for applying animal whisker components to a covering such as a textile material of the class employed in making toy animals such as teddy bears and the like.

Still another specific object of the invention is to devise a fabricated filament bundle construction which occurs in the form of a web clip which can be utilized for feeding individual anchor barbs on the web clips into a position to be actuated by an injection rod of the injection gun structure.

Still another object of the invention is to devise fabricated filament bundles which are secured at their ends in molded anchor barbs presenting pointed end portions which can be inserted in the injector gun means in a leading position.

The nature of the invention and its other objects and novel features will be apparent from the following detailed description of the invention.

DETAILED DESCRIPTION OF THE INVENTION

Referring in more detail to the drawings, the invention subject matter illustrated therein generally comprises a fabricated filament bundle construction which is provided with barbed anchoring means for attaching filament bundles to a covering such as a textile material.

A plurality of the filament bundles are uniquely arranged in connected relationship to one another to constitute a web clip of bundles and anchor barbs which may be cut to desired lengths and attached to a covering by a specially designed injector mechanism.

The filament bundles are especially suited for being attached to a covering of a toy animal such as a teddy bear to constitute artificial animal whiskers and the invention is hereinafter described with reference to animal whiskers. However, it should be understood that the invention is not limited to the manufacture and use of fiber filament bundles for whiskers but may also be applied to fabric coverings and the like for other purposes.

Figure 1:
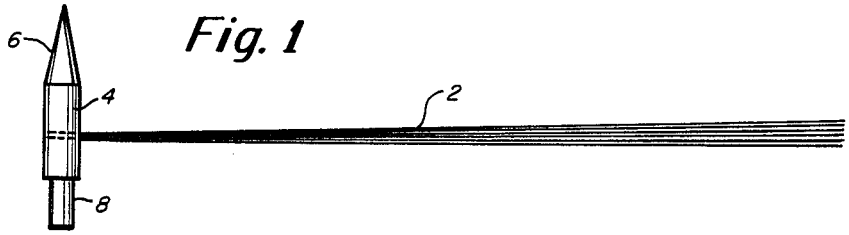
FIG. 1 is a detail elevational view of a bundle of plastic filaments whose end portions are secured together by a molded anchor barb to constitute a simulated animal whisker component of the invention.
Figure 2:
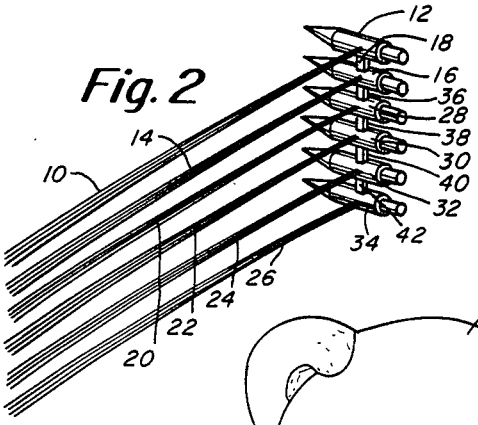
FIG. 2 is a detail perspective view of a plurality of filament bundles attached to one another in spaced apart relation by web portions to provide a web clip of anchor barbs which may be successively cut off and driven into the covering of a toy animal.

FIGS. 1 and 2 illustrate the fiber bundle construction and the web clip arrangement of the fiber bundles.

Figure 3:
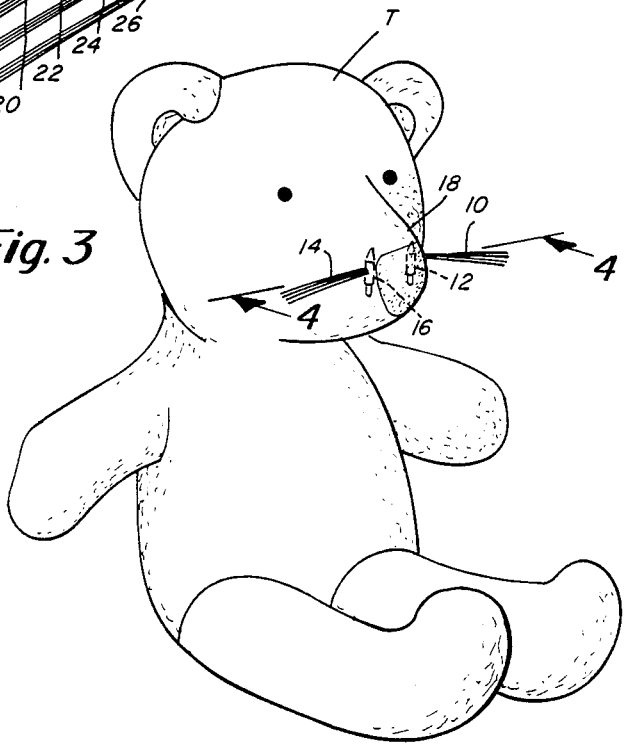
FIG. 3 is a perspective view of a toy animal illustrative of a toy teddy bear and indicating filament bundles supported at either side of the nose portion of the toy animal.
Figure 4:
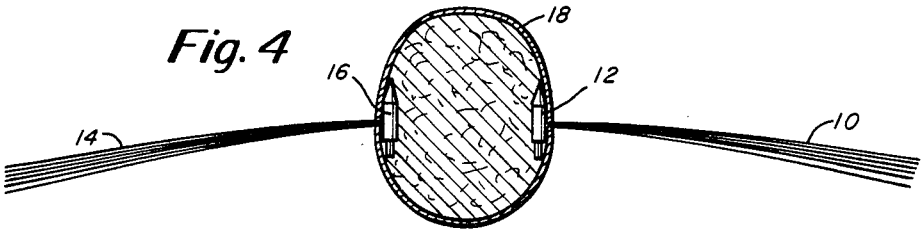
FIG. 4 is a cross section taken on the line 4—4 of FIG. 3.

FIGS. 3 and 4 illustrate the bundles utilized to provide artificial whiskers for a teddy bear and FIG. 4 illustrates the anchored relationship of the barbs inside of a covering material such as that of a teddy bear.

Figure 5:
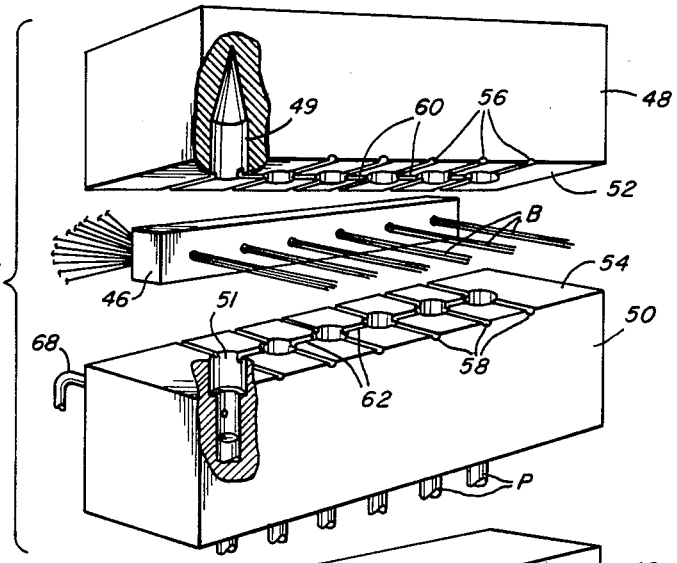
FIG. 5 is a perspective view illustrating upper and lower die components separated to receive filament bundles from a gathering die to be used in forming animal whisker components of the invention.
Figure 6:
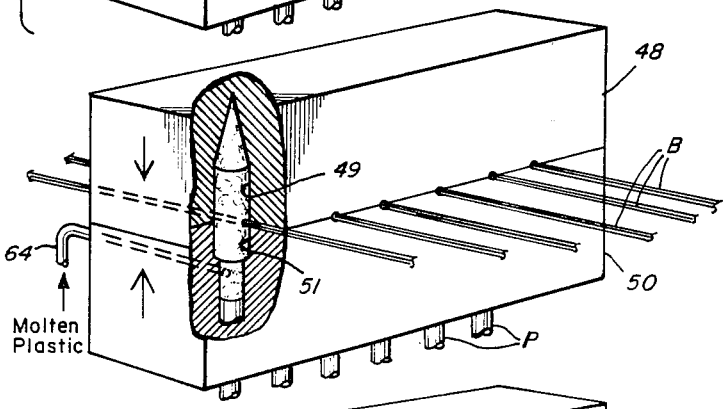
FIG. 6 illustrates the upper and lower die components in a closed position in which molten plastic has been forced into mold openings to provide anchor barbs for securing filaments in each bundle and simultaneously attaching the bundles by web portions.
Figure 7:
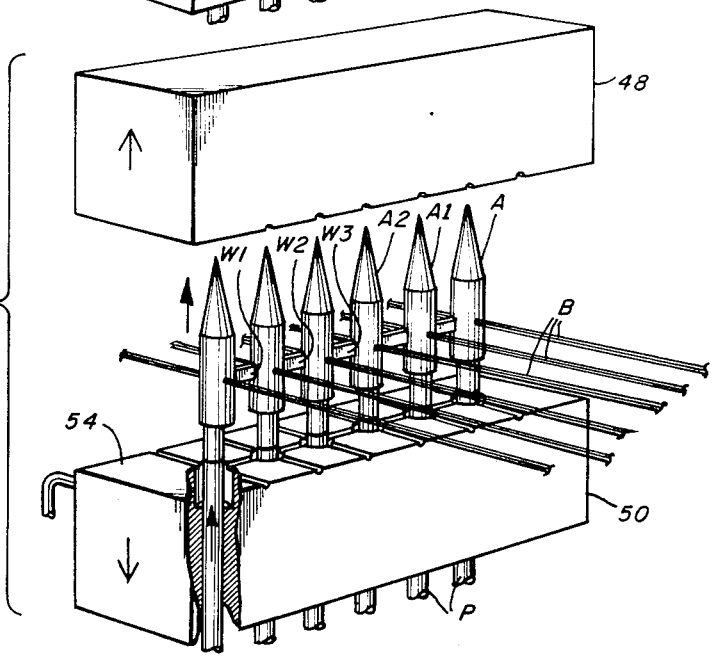
FIG. 7 is another perspective view indicating the die components in an opened position and further illustrating a finished web clip of connected anchor barbs and filament bundles ejected from the lower die component.

FIGS. 5, 6 and 7 illustrate molding die apparatus for forming fiber bundles and securing them in connected relationship with anchor barbs.

FIGS. 8 through 18 illustrate apparatus for handling the web clips of filaments and anchor barbs and cutting them off to desired lengths.

The remaining FIGS. 19 through 43 illustrate the construction and use of one desirable injector mechanism for detaching individual anchor barbs and filament bundles from a web clip and applying to a covering material.

Considering in further detail the filament bundle construction, shown in FIGS. 1 and 2, it should be understood that the number of filaments in a bundle, as well as the number of bundles, may be varied in accordance with any desired requirement. For example, in one preferred embodiment there may be in the web clip as many as 24 bundles and each bundle may include, for example, 12 filaments joined together. These filaments may consist of a plastic material such as polypropylene which may be supplied from spools of such plastic material. The length of the filaments is uniform in the case of serving as artificial whiskers for a toy teddy bear and may be of a length of from 3 to 4 inches. Other lengths, however, may be desirable.

Numeral 4 refers to an anchoring member which is arranged to secure ends of the filaments together as shown. The anchoring member is hereinafter referred to as an anchor barb and is constructed with a cylindrically shaped body, one end of which is formed with a pointed tip 6. An opposite end of the anchor barb 4 is provided with a reduced extremity 8, also of cylindrical shape. It would be understood that the pointed tip serves as a piercing means for entering a covering material when driven by an injection gun, as hereinafter disclosed in detail. The reduced end 8 is designed to be received in an injector rod of the injection gun.

As noted above, an important feature of the invention is the arrangement of a plurality of filaments and respective anchor barbs in connected relationship. FIG. 2 is intended to illustrate one such arrangement. As noted therein, a filament bundle 10 and anchor barb 12 are located in an uppermost position and are connected in spaced apart relation to a filament bundle 14 and anchor barb 16 by means of web 18. Similarly, filament bundles as 20, 22, 24 and 26 are connected to anchor barbs as 28, 30, 32 and 34 by web portions as 36, 38, 40 and 42.

This arrangement is designed to support a plurality of filament bundles and connecting web portions to constitute a web clip in which the anchor barbs occur in substantially parallel relation to adjacent barbs and each anchor barb extends substantially at right angles to a respective filament bundle which it encloses. It is again pointed out that in FIG. 2 six anchor barbs are shown and this is intended to be illustrative of a web clip of 24 anchor barbs or any other desired number.

It is contemplated that web clips of 24 anchor barb and filament size or other desired number is to be produced, as hereinafter disclosed, as an article of manufacture which can be packaged, supported in handling trays or otherwise contained.

In FIG. 3 a toy animal such as a teddy bear T is shown with the filament bundles and anchor barbs attached at either side of the nose portion of the teddy bear T to present the appearance of whiskers. It may be assumed that anchor barb 12 and filament bundle 10 have been cut off and attached by suitable injection gun means such as is disclosed in FIGS. 10–43. Similarly, anchor barb 16 and filament bundle 14 are successively cut and then attached by the same injection means. The anchor barbs 12 and 14 are further indicated diagrammatically in FIG. 4 in which it will be seen that the anchor barbs having pierced the covering material of the teddy bear nose has turned over into its normally right angularly disposed position so that it completely anchors the respective filament bundle against an inner side of the covering N in which position it is resistant to any force seeking to dislodge the filament bundle. The same is true with the anchor barb 16 and the filament bundle. It is also pointed out that with the arrangement described filaments, as they extend outwardly from the anchored barbs tend to separate from one another to provide an accentuated whisker simulation.

In accordance with the invention there has been devised a method and means for forming molded web clips of anchor barbs and attached filament bundles having the structural characteristics above disclosed. In carrying out the invention method filaments of a flexible plastic material, as for example polypropylene, are drawn off from wound spools of the filaments and gathered into bundles of a desired number of filaments. The filaments in each bundle are thereafter secured together by anchor barbs which are molded therearound and which present pointed end portions. Simultaneously molded web portions are formed in a position to connect together a desired number of bundles in spaced apart relationship.

Attention is directed to FIGS. 5–18, inclusive. As shown therein, plastic filaments as F are supplied from a plurality of spools of wound filaments, most clearly shown in FIG. 12 and denoted by the reference characters S, S1, S2, etc. The filaments are drawn off from the spools and led into a gathering die 46, which is formed with tapered inlets in which a desired number of filaments such as 12 filaments, for example, are grouped together to form spaced apart bundles B. These spaced apart bundles are guided along substantially horizontal paths of travel and immediately after leaving the gathering die 46 are received between upper and lower molding die members which are designed to apply anchor barbs around the bundles at selected points.

In the bundle arrangement shown in FIGS. 12–18, inclusive, 24 bundles are employed and die members as 43 and 45 are constructed to form 24 anchor barbs and filament bundles in web clip form. However, in FIGS. 5–7 a simplified mold arrangement is illustrated in which only 6 bundles are dealt with. It will be understood that construction of mold members in FIGS. 5–7, hereinafter described, are similar to the mold members of FIGS. 12–18.

Considering in further detail the mold structures shown in FIGS. 5–7, inclusive, it will be seen that there is provided upper and lower mold components 48 and 50 and the mold component 48 is movable vertically into and out of contact with the mold 50. In each of the molds anchor barb forming openings are provided as openings 49 in upper die 48 and openings 51 in lower die 50. The two die members are further constructed with contacting surfaces as 52 and 54 which are formed with slots as 56 and 58, respectively. These slots are arranged in alignment with the bundles B leaving the gathering die and are operative in a closed position to engage around upper and lower portions of each of the bundles. These contacting surfaces 52 and 54 are still further constructed with web forming slots as 60 and 62 and the location of these slots occurs in centrally disposed intersecting relation with the respective anchor barb openings in the two dies.

Molten plastic material may be introduced when the dies are in a closed position through inlets 64 and 68 and the anchor barbs are then formed and the dies are separated, as shown in FIG. 7, with each of the anchor barbs and filament bundles being ejected by means of knockout pins P provided in the bottom of the lower die so that the resulting web clip of anchor barbs is in raised relation to the surface 54 of the mold part 50. It will also be observed that each of the anchor barbs formed, as shown in FIG. 7, are connected together by web portions W formed by the slots 60 and 62 in the contacting surfaces of the mold. There is thus produced a web clip of anchor barbs which are ready to be advanced to a cutting station.

In FIGS. 8, 9, 10 and 11 there has been shown schematically a reciprocating rake apparatus which is operable to be located in back of the web clip, as shown in FIG. 7, and to draw this web clip into register with a cutting station which is actuated by a pressure actuated cylinder.

Figure 8:
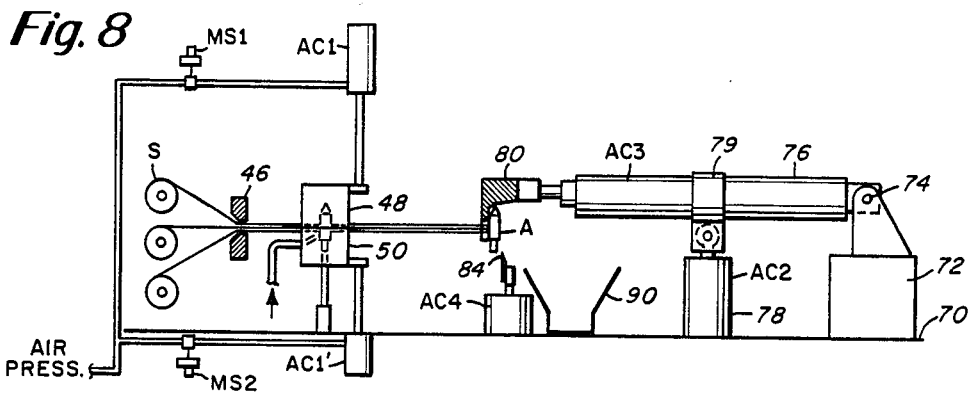
FIG. 8 is a side elevational view illustrating diagrammatically invention apparatus for producing web clips of anchor barbs and filament bundles cut to a desired filament lengths and delivered to a storage hopper.
Figure 9:
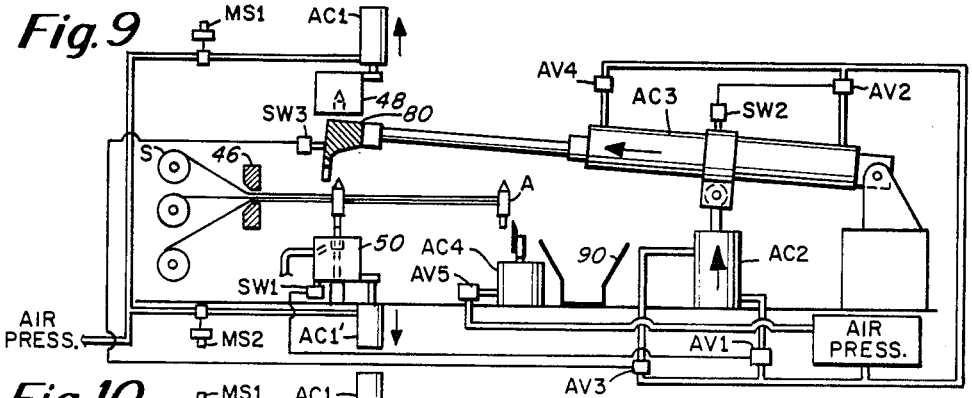
FIG. 9 is a view similar to FIG. 8 but illustrating a rake component in a forwardly extending position about and about to engage a web clip of anchor barbs, leaving the molding apparatus.
Figure 16:
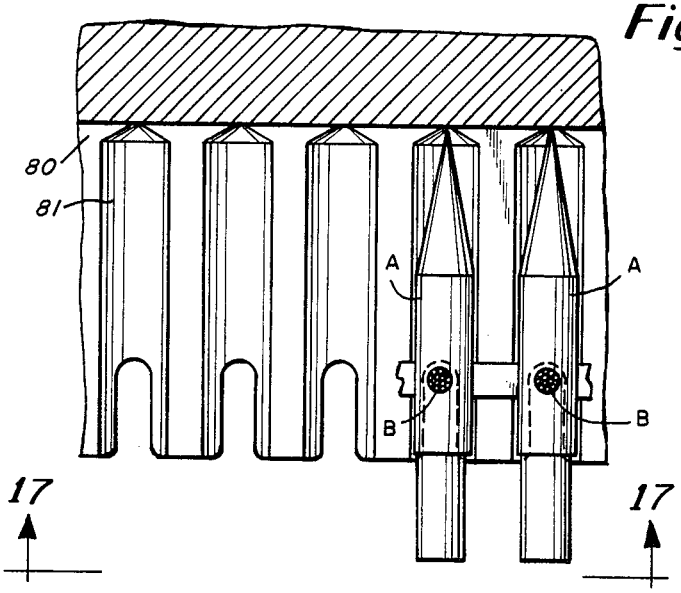
FIG. 16 is a detail elevational view of a portion of the rake apparatus engaged against an inner side of a web clip of anchor barbs.
Figure 17:
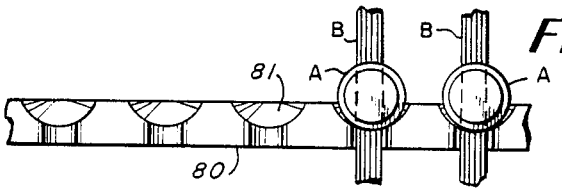
FIG. 17 is a view taken on the line 17—17 of FIG. 16.
Figure 18:
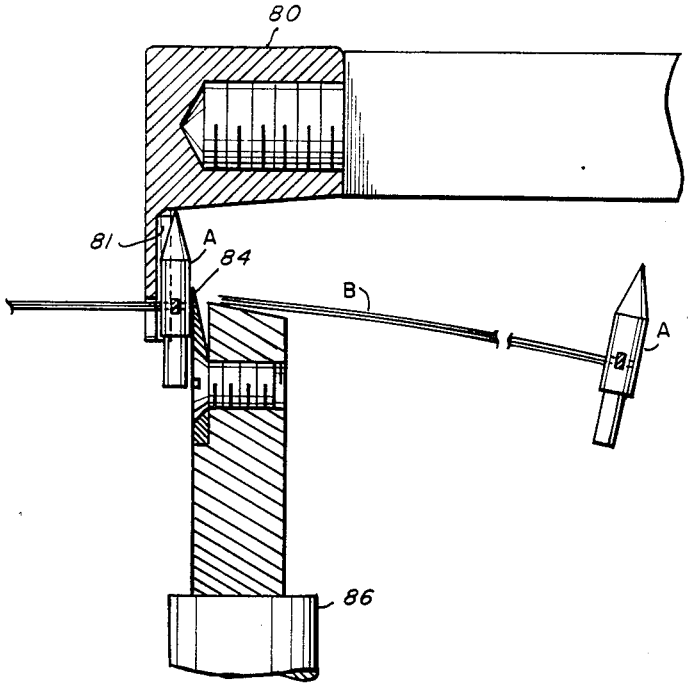
FIG. 18 is a detail view further illustrating the anchor barbs entered into a cutting station.
Figure 19:
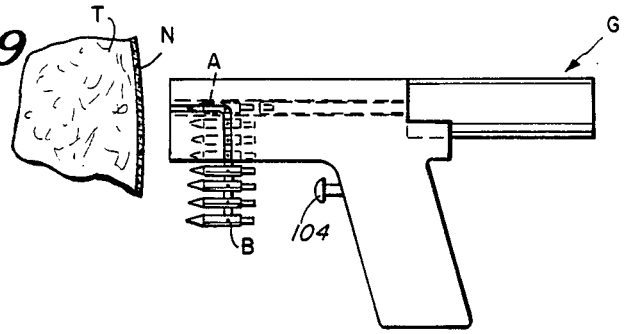
FIG. 19 is side elevational view illustrating fragmentarily a portion of a teddy bear covering and an injection gun device of the invention with a clip of anchor barbs received therein.

The rake apparatus of FIGS. 8, 9, 10 and 11 is shown in more detail in FIGS. 12–18 and includes a base or table 70 at one end of which is mounted a supporting structure 72 having pivot means 74 at the upper side thereof to which is pivotally attached one end of a pressure actuated cylinder 76. Also mounted in the base 70 is a second cylinder 78 having a collar part 79 formed around a mid section of the cylinder 76. When cylinder 78 is actuated it turns cylinder 76 about the pivot 74 and in a raised position cylinder 76 may be actuated to advance a rake device 80 over anchor barba A, A1, A2, etc., as shown in FIG. 7. Along one side the rake 80 is formed with indented surfaces 87, as shown in FIG. 16, which are designed to engage in back of the anchor barbs, as has also been suggested in FIG. 17. In this position the rake may be retracted by the cylinder 76 and this moves this anchor barb clip into a cutting station immediately above a cutting blade 84 which is operated by a third cylinder 86, as is shown in FIGS. 8 and 9.

After locating a first anchor barb clip in the position described, as shown in FIG. 8, the rake apparatus is again advanced to engage in back of a second anchor barb clip which has been formed in the die members of FIGS. 5 through 7.

Figure 10:
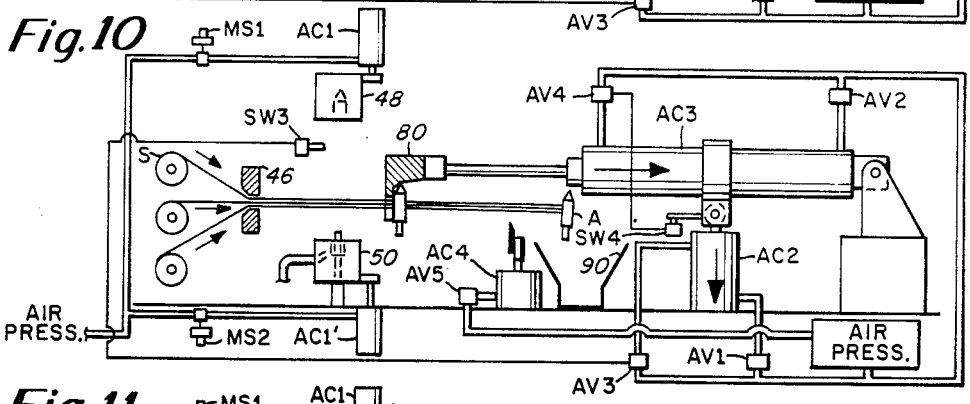
FIG. 10 is a view similar to FIG. 9 showing the rake engaged in back of the web clip of anchor barbs and partly retracted.
Figure 11:
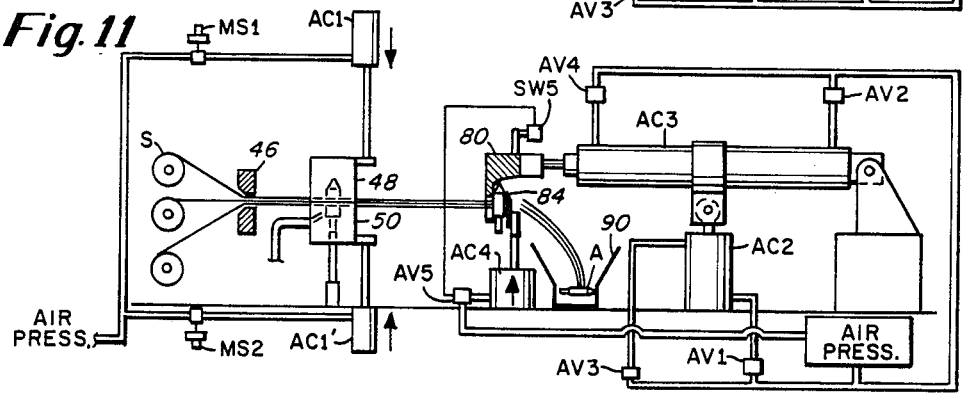
FIG. 11 illustrates the rake retracted and a length of anchor barbs being cut off and dropped into a storage bin.
Figure 12:
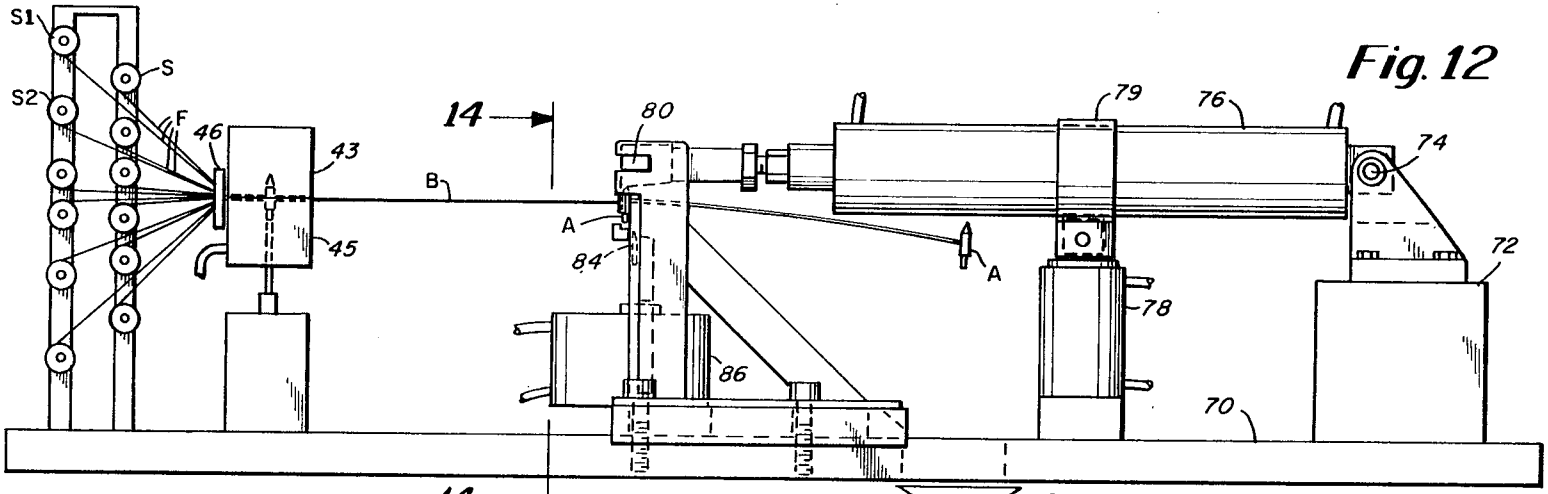
FIG. 12 is a view showing the apparatus of FIG. 8 in more detailed form.
Figure 13:
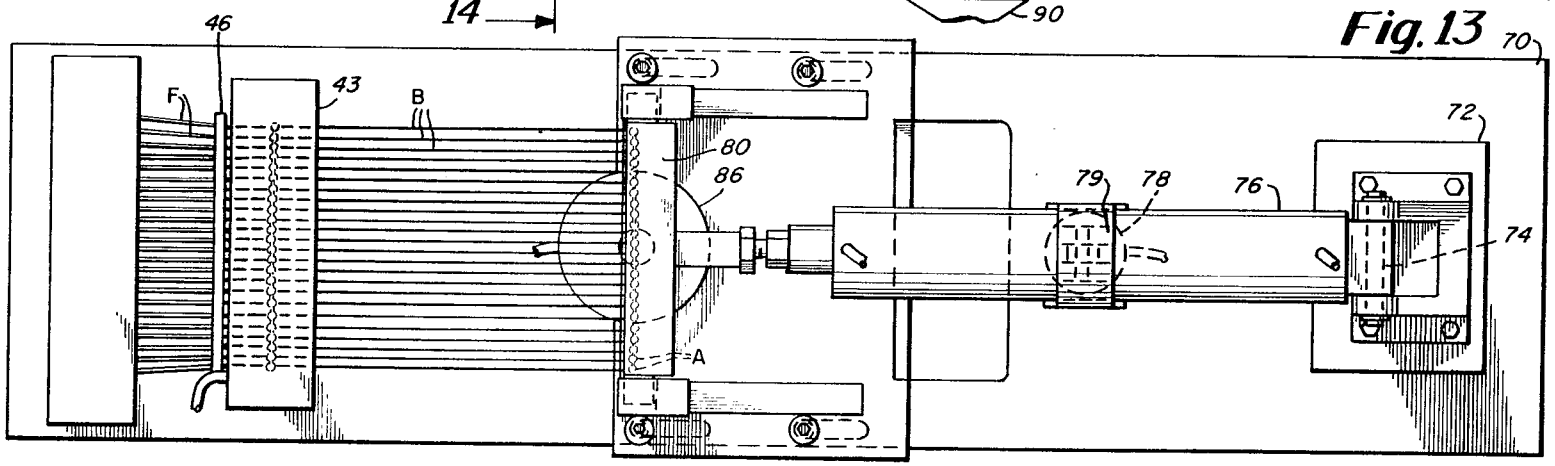
FIG. 13 is a plan view of the apparatus shown in FIG. 12.
Figure 14:
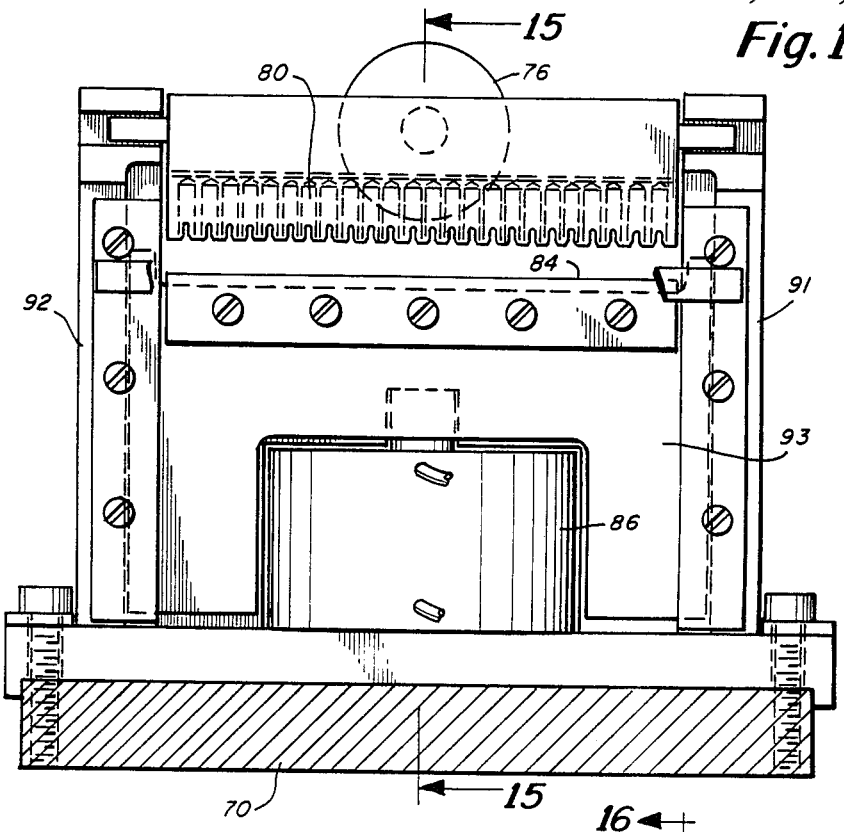
FIG. 14 is a cross section taken on the line 14—14 of FIG. 12.
Figure 15:
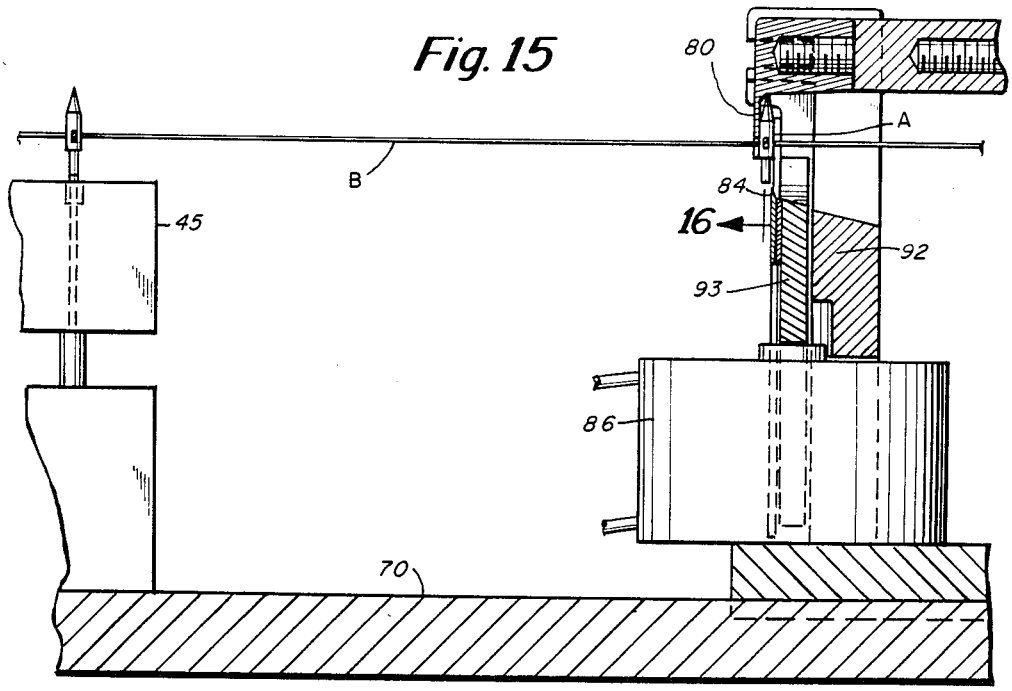
FIG. 15 is a cross sectional view taken on the line 15—15 of FIG. 14.

The second anchor barb clip is then moved into the cutting station. Thereafter, the cutting blade 84 is operated cutting off the filaments of the first anchor barb clip which is dropped into a storage hopper 90, as shown in FIGS. 8, 9 and 10. This operation of forming anchor barb clips and advancing them to a cutting station is intended to be successively carried out by the apparatus described and it is pointed out that the anchor barb clip which is left in the cutting station to be advanced into a cutting position will present untrimmed end portions which are required to be trimmed off as is hereinafter described. and disclosed.

It will be understood that the several operations of drawing off dilaments arranged in spaced apart bundles forming anchor barba around the bundles and ejecting a finished anchor barb clip for being advanced to the cutting station by the rake device is carried out in a timed relationship which involves a number of switches and air cylinders schematically shown in FIGS. 8, 9, 10 and 11.

Assuming that the entire apparatus as shown in FIGS. 8–13 is at rest, operation may be initiated by providing main control switches MS1 and MS2 which, in one desired arrangement, may be positioned at a convenient location adjacent to the molding die components, as has been shown diagrammatically in FIG. 8.

Included with the main control switches MS1 and MS2 are air valves, not shown, controlled by the switch to activate air cylinder AC1 and AC1′ and move the mold components apart. When the mold components are fully opened switch SW1 is closed and energizes an air valve AV1 which operates air cylinder AC2, moving the rake 80 up until switch SW2 is contacted. This activates an air valve AV2 energizing the air cylinder AC3 which pushes the rake 80 outwardly to contact switch SW3. This in turn activates air valve AV3, energizing air cylinder A2 downwardly to locate the rake 80 behind molded anchors. Switch SW4 is then contacted activating air valve AV4 moving cylinder A2 and pulling the rake and anchors in until switch SW5 is contacted (FIG. 11) by the rake head activating air valve AV5, energizing cylinder 4, extending it and cutting the filaments off.

Figure 43:
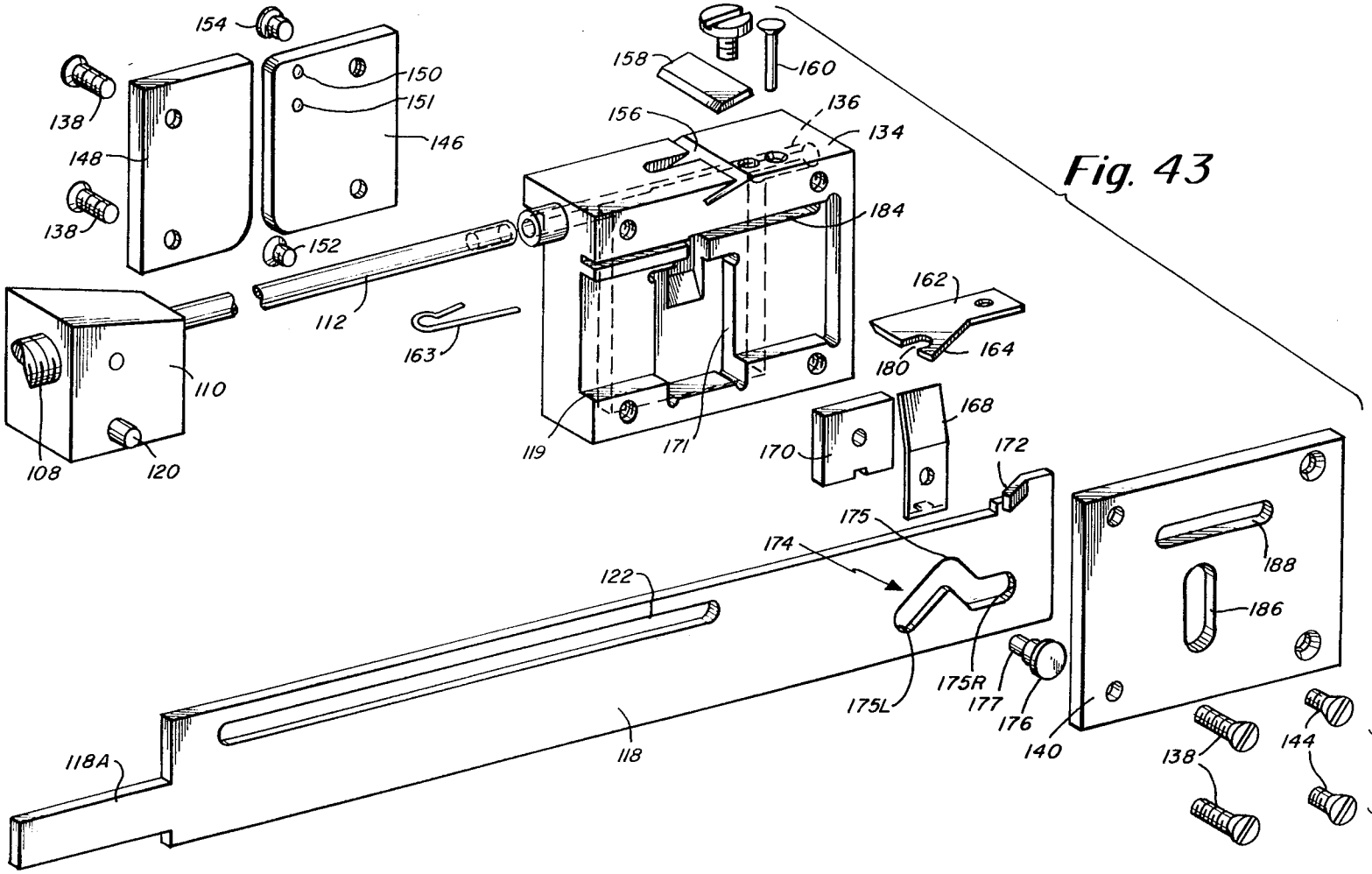
FIG. 43 is a perspective view showing the various components of the injector gun in exploded relationship.
Figure 44:
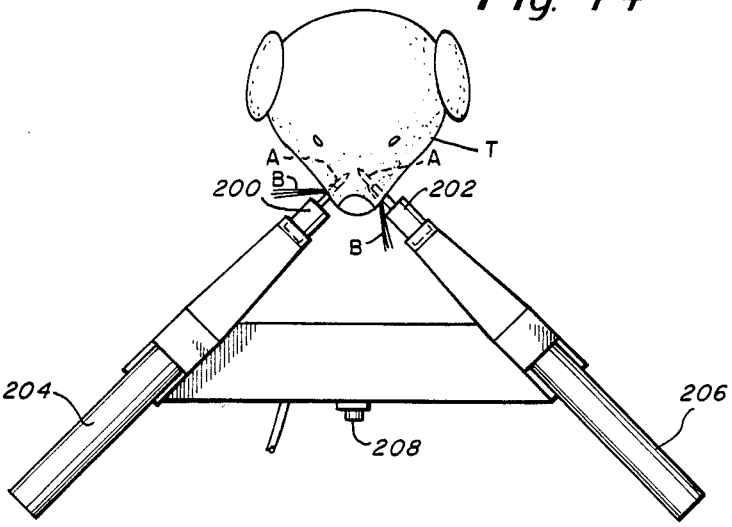
FIG. 44 illustrates a modified injection gun arrangement of the invention.
Figure 45:
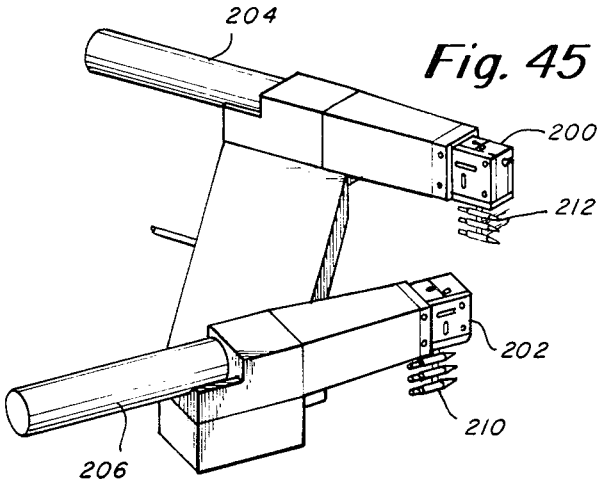
FIG. 45 shows further details of the modification of FIG. 44.

The web clips of anchor barbs are removed from the storage hopper, manually or if desired mechanically, and individual anchor barbs are injected into a covering material employing invention injector mechanism such as that shown in FIGS. 19–43, and also such as that shown in FIGS. 44 and 45.

It is pointed out that each anchor barb in a web clip being processed is required to undergo several unique steps which are carried out by the injector mechanism, which is illustrated in FIGS. 19–43, hereinafter referred to as an injector gun. Thus, the uppermost anchor barb in the web clip is first required to be engaged in a magazine portion of the injector gun mechanism in a position immediately below the barrel of the gun through which the anchor barb is to be ejected. Then, the anchor barb is mechanically forced up into the barrel and thereafter its connecting web is cut and the anchor barb is ready to be ejected.

Principal parts of the gun mechanism include a housing body having a magazine block and barrel attached at one end and a reciprocating injector mechanism, preferably pneumatically activated, received at an opposite end. A handle detachably secured to the housing supports a control trigger for operating the reciprocating injector means.

Figure 20:
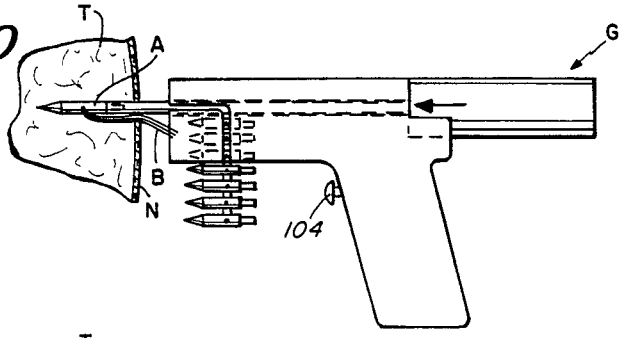
FIG. 20 is a view showing the injection gun having advanced an anchor barb into the teddy bear covering.
Figure 21:
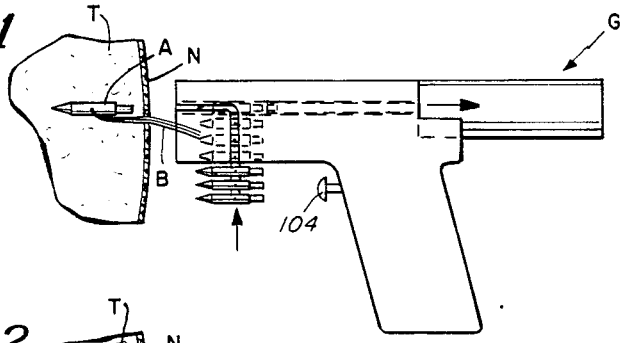
FIG. 21 illustrates the injector gun with its starting to retract.
Figure 22:
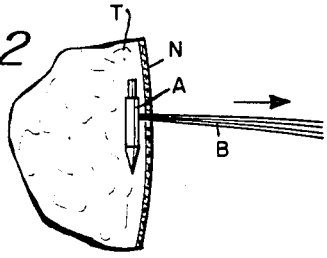
FIG. 22 illustrates the anchor barb of FIGS. 20 and 21 turned back upon itself in a fully anchored position.

Considering this structure in further detail, as shown in FIGS. 19–22, the injector gun mechanism, generally indicated by the arrow G, has received therein a web clip of anchor barb A and filament bundles B for attachment to a nose cover N of a teddy bear T. FIGS. 20 and 21 illustrate an anchor barb and handle device driven through the nose cover N with a portion of filament bundle B depending from the cover N with a portion of filament bundle B depending from the covering N. FIG. 22 illustrates the filament bundle B pulled outwardly and the anchor barb A turned over into its normal right angularly disposed position in which it is firmly anchored against an inner surface of the nose covering N.

Figures 23, 24, 25, 26:
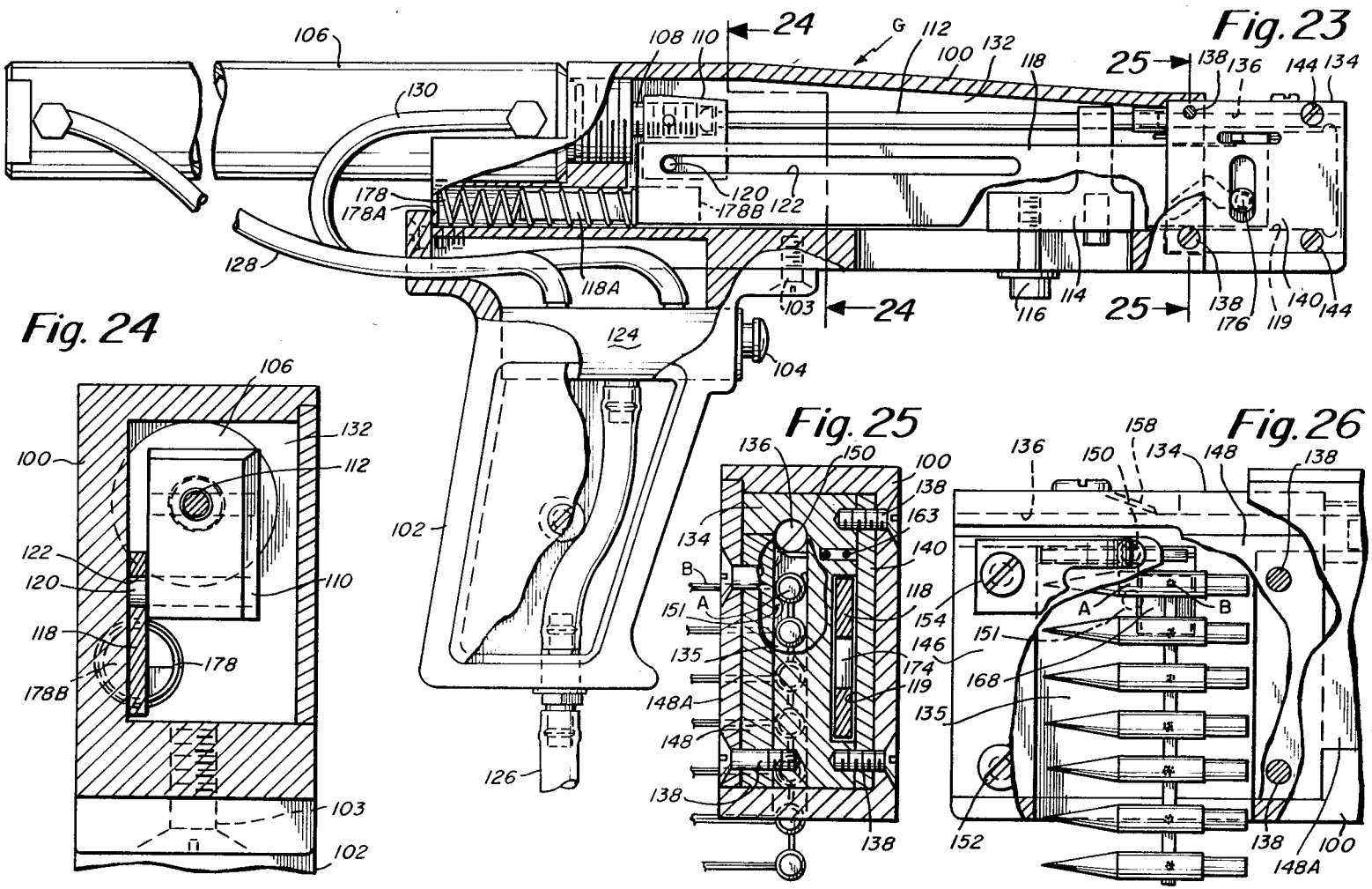
FIG. 23 is a side elevational view showing the injector gun on a larger scale and having portions thereof broken away to show operating components.
FIG. 24 is a cross section taken on the line 24—24 of FIG. 23.
FIG. 25 is a cross section taken on the line 25—25 of FIG. 23.
FIG. 26 is a detail cross sectional view of portions of the anchor gun with the web clip of anchor barbs entered therein.
Figure 30:
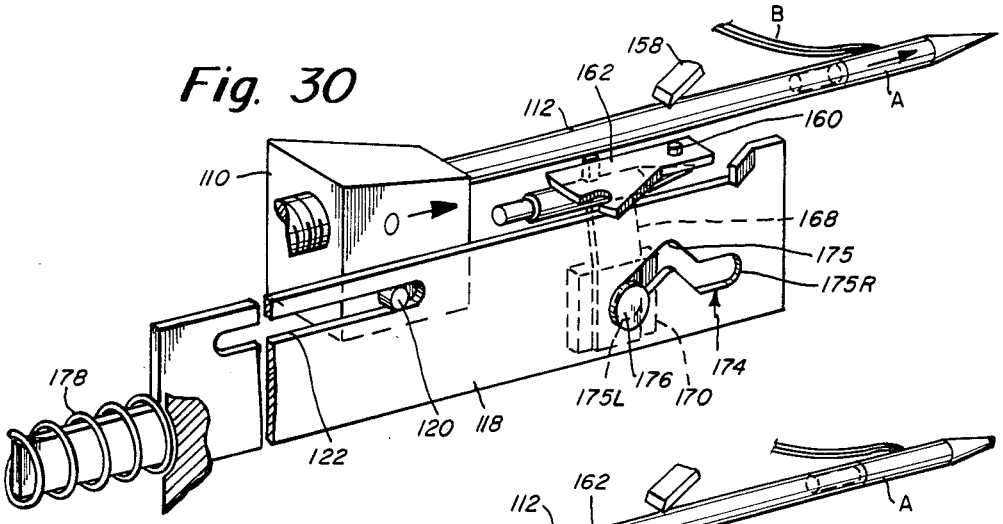
FIG. 30 is a perspective view showing the shoulder pin in another operative position in the slide bar groove.
Figure 31:
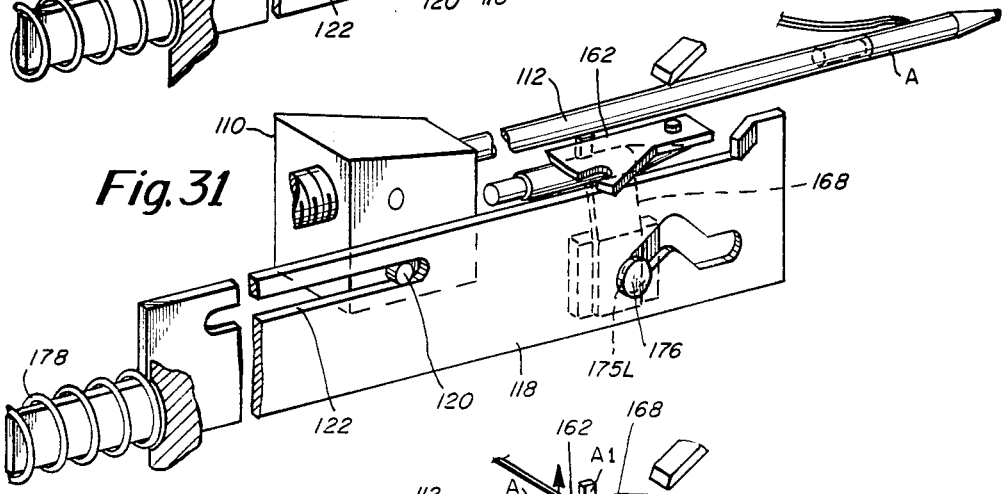
FIG. 31 is a view similar to FIG. 30 showing the slide bar fully extended and ready to be retracted.
Figure 42:
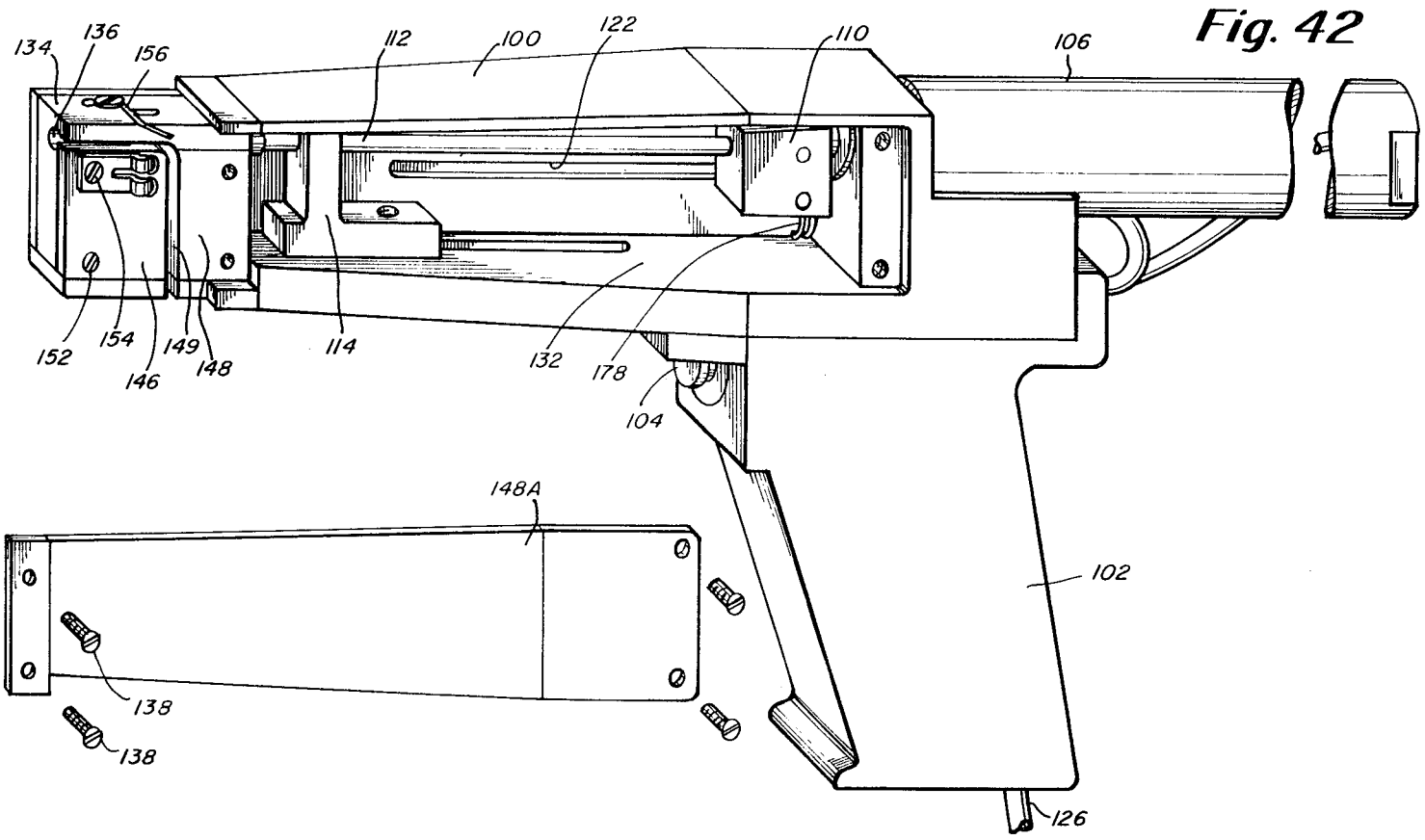
FIG. 42 is a perspective view of the injector gun as viewed from an opposite side to show an opening for receiving a clip of anchor barbs therethrough.

In FIGS. 23 and 42 the injector gun mechanism G is shown as viewed from two opposite sides thereof with portions of the structure partly broken away. Numeral 100 denotes a housing body to which is detachably secured a handle 102 by means of screws 103. Supported at one end of housing body 100 is an air cylinder 106. A compressed air supply 126 connected into handle 102 supplies compressed air through a 4-way valve 124. A conduit 128 supplies compressed air from the 4-way valve to the air cylinder 106 to inject in a conduit 130 a supply of air to retract the air cylinder. Operation of the 4-way air valve 124 is controlled by a switch or a trigger 104 at the front of handle 102.

The housing body 100 is, in one desirable form, constructed from a casting provided with a chamber 132 into which extends a plunger 108 of the air cylinder 106, as is most clearly shown in FIG. 42. Solidly secured to an inner end of the plunger 108 is an injection rod carrier block 110 in which is secured an injection rod 112. Forward travel of the carrier block 110 is limited by a stop bar 114 which is adjustable along the bottom of the chamber 132 and may be secured in a desired setting by an adjustment screw 116 located through the bottom on the housing. The stop 114 determines the travel distance of the injection rod carrier block 110 which in turn determines the distance through which the injector rod enters a covering body.

The injection rod 112 is located through a guide part 115 of the stop bar 114, as is indicated in FIGS. 23 and 24 and is received through an injection rod barrel 136. The barrel 136 is formed as a part of a magazine block 134 attached at the outer end of the housing body 100, as indicated in FIGS. 23 and 42 by means of attaching screws 138 which also secure against the magazine block 134 a holding plate 148, best shown in FIG. 42.

An important feature of the gun mechanism of the invention resides in the construction of the magazine block 134 with web clip guideway means and a clip loading mechanism adjustably supported at one side of the guideway means. The magazine block and its associated parts are shown in greater detail in the exploded view of FIG. 43 and is also shown in FIGS. 38 and 39.

Figure 38:
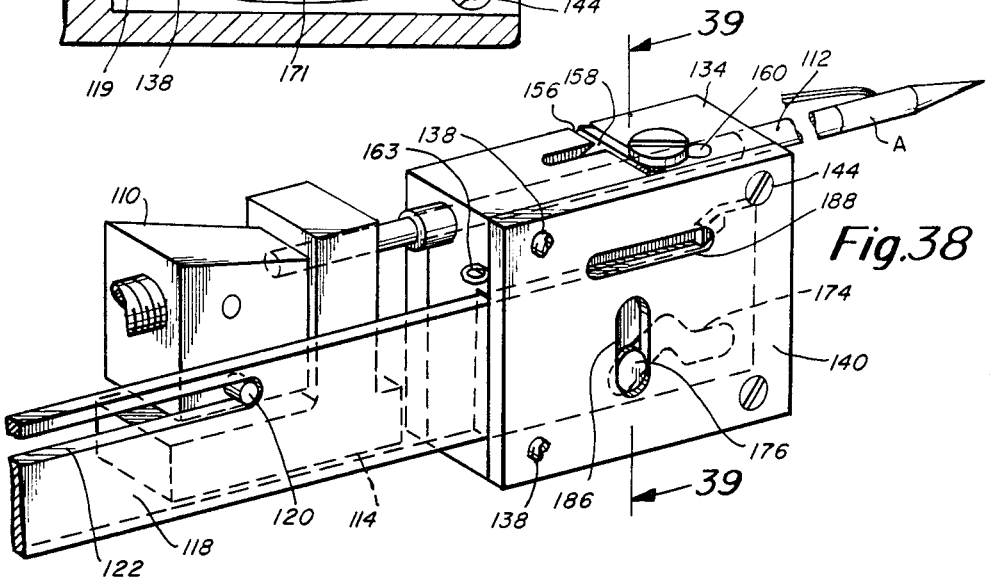
FIG. 38 is a perspective view illustrating the slide bar in the magazine block.
Figure 39:
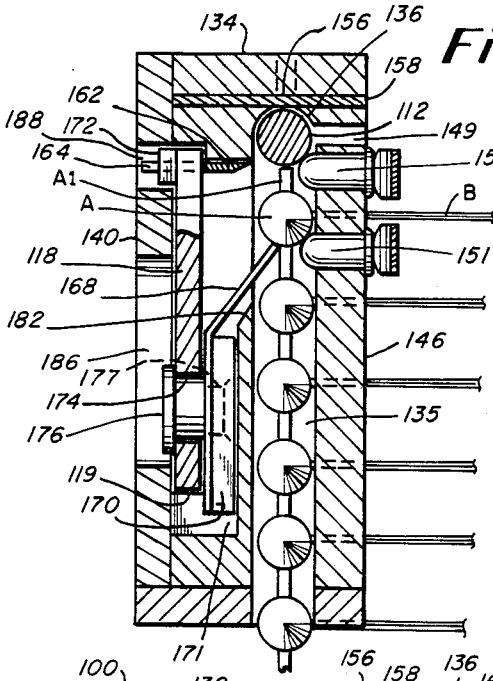
FIG. 39 is a cross section taken on the line 39—39 of FIG. 37.
Figure 40:
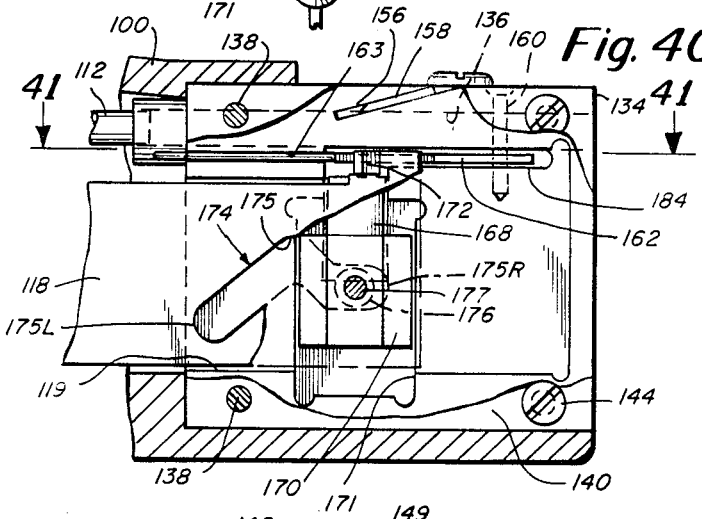
FIG. 40 is a detail cross sectional view.

Considering first the clip guideway means, attention is directed to FIGS. 38 and 39. Numeral 135 denotes a web clip guideway which extends upwardly from the bottom side of the magazine block to communicate with the injector barrel 136. One side of the clip guideway 135 is defined by a cover plate 146, shown in FIG. 42 attached to the magazine block by screws as 152 and 154.

It will be noted that the cover plate 146, as shown in FIG. 42, is arranged in spaced relation to the holding plate 148 to define a filament bundle slideway 149 through which outwardly extending filament bundles may be received when a web clip of anchor barbs is introduced into the clip guideway 135. In thus introducing the web clip upwardly through the guideway 135 it should be observed that means are provided for holding the web clip in place once it has been inserted. The means noted is most clearly shown in FIGS. 39 and 43 and consists of spring loaded ball detents 150 and 151 resiliently received in spring loaded apertures formed in the cover plate 146.

The clip loading mechanism, noted above as forming a part of the magazine block, is arranged in cooperating relationship to the clip guideway 135 disclosed. Included in the clip loading mechanism is a web clip advance finger and shoulder pin mechanism, cutting blade means and slide bar means movable in the magazine block in response to reciprocating travel of the injection rod to raise the shoulder pin and move the advance finger upwardly. These parts are most clearly shown in FIGS. 23 and 43, and are also shown in FIGS. 27–38, inclusive. As shown in FIG. 43, one side of the magazine block is formed with a channel 119.

An opposite end of slide bar 118 has a reduced part 118A engaged against a coil spring 178 and is received against one side of the carrier block 110. As shown in FIG. 23, the slide bar 118 is formed with an elongated slot 122 and has recieved therethrough a pickup pin 120 which is operative to maintain the slide bar against the resilience of spring 178 in a fully retracted position. It will be understood that by means of this arrangement the slide bar will normally be held by pin 120 in a fully retracted position, as shown in FIG. 23, and when the injector rod and carrier block start to move forwardly the slide bar is urged forwardly by the coil spring 178 with the forward end of the slide bar being advanced through a channel in the magazine block. A specially devised feature of the slide bar is a cam groove, generally denoted by the arrow 174, designed to receive therethrough a shoulder pin 176, which is most clearly shown in FIG. 43. The cam groove 174 is of an undulating shape having a high point 175, a low point at the left 175L and another low point on the right 175R and it is pointed out that the low point 175R is slightly higher than the low point 175L.

The shoulder pin 176, as shown in FIG. 43, is formed with a reduced inner extremity 172 which is received through the cam groove 174 and then extends through an advance finger element 168 to become fixed in a guide part 170 which is received for sliding movement in a recess 171 in the magazine block 134.

It will be seen that when the slide bar is moved in and out of the channel 119 in the magazine block the guide part 170 will undergo vertical sliding movement in response to changing positions of the shoulder pin 176 along the cam groove 174. When the shoulder pin 176 is in the central high portion 175 of the groove the guide part 170 raises the advance finger 168 against a ramp 182 of the magazine block so that it extends into the magazine block guideway 135 in a position to engage at the underside of an anchor barb therein.

This assembly of parts is secured together by a retaining plate 140 fastened to the magazine block 174 by screws 144, as is best shown in FIGS. 38 and 39. A vertically elongated slot 186 is provided in the cover plate 140 to provide for vertical movement of the shoulder pin 136 in the plate 140.

Figure 41:
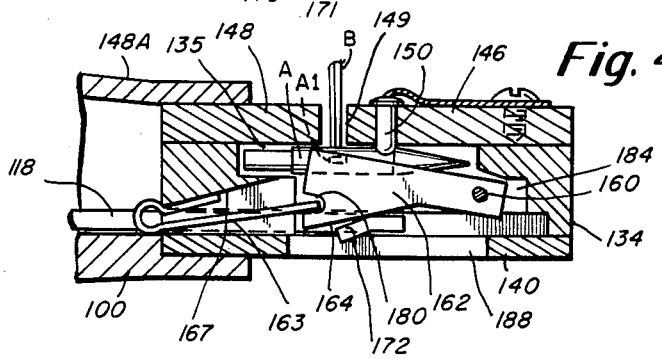
FIG. 41 is a cross section taken on the line 41—41 of FIG. 40.

The retaining plate 140 also functions to hold in place a cutoff blade 162 which is located in a blade aperture 163 formed in the magazine block 134, as shown in FIG. 43. The cutoff blade is mounted for rotation about a pivot pin 160, also shown in FIG. 43. In one position of rotation the cutoff blade may be swung through the aperture 163 a distance sufficient to cut off an anchor barb web portion in the guideway 135. A spring element 163 having a shape as shown in FIGS. 41 and 43, for example, is located at one side of the aperture 163, as best shown in FIG. 41, and resiliently engages a notch 180 in the cutoff blade 162 and functions to urge the cutoff blade into a normally outwardly extended position.

A cam part 164 formed on the blade 162 is arranged to extend through a cutting blade aperture 188 in plate 140. Cooperating with the cam surface 164 is a cam element 172 formed at an upper side of the slide bar 118, as shown in FIGS. 41 and 43. The cam element 172 is arranged in a position such that when the slide bar is retracted the cam element 172 engages against the cam part 164 forcing the cutoff blade to move into the guideway 135 in a position to cut off a web clip from an anchor barb and the blade is held in this position until the slide bar opening moves forwardly.

At the upper side of the magazine block 139 there is also provided an inclined slot 156 in which is received a trim blade 158. As shown in FIG. 27, an anchor barb which is being moved upwardly into the barrel 136 will present a cut off end 189 and a space 190 is provided through which a cut end may project, as shown in FIG. 29. Trim blade 158 extends angularly downwardly into a position in which its cutting edge may engage flush against the cut end and the cut off end is shaved off when the anchor barb is driven forwardly by the injector rod, as is suggested in FIG. 28.

In operating the gun mechanism to handle the web clip of anchor barbs, a web clip is inserted at the under side of the magazine block through the guideway 135 in the magazine block to locate an uppermost anchor barb between the ball detents 150 and 151. With the clip in this position it will be understood that it is necessary to operate the air gun a first time in order to make use of both forward travel and the rearward travel of the injector rod and slide bar 118. Since no anchor barb is in the barrel during the first forward travel of the rod nothing occurs, but rearward travel of the rod provides for moving the engaged anchor barb from between the ball detents into the injection rod barrel by means of the advance finger mechanism. Thereafter, cutting off of the connecting web takes place and the gun is ready to start operating.

To activate the air cylinder 106 the trigger 104 is squeezed inwardly and as long as the trigger is held compressed it is forcing the plunger forwardly. When the trigger is released, the 4-way valve 124 operates to retract the air plunger and the injector rod.

Assuming that an anchor barb has been moved into position in the barrel 136 and its connecting web severed, the slide bar is in a fully retracted position such as is shown in FIG. 23 with the pickup pin 120 in slot 122 compressing the slide bar against coiled spring 178. It will be observed that in thus moving the slide bar into a fully retracted position, the shoulder pin 176 has been moved along the cam groove denoted by arrow 174 to the low end, 175R, of the groove in which position the advance finger 168 is resting against an upper side of an anchor barb which is to be loaded.

FIG. 27 shows the shoulder pin in the position described and FIGS. 28 through 35 are sequence views illustrating several operations which take place when the trigger 104 is squeezed.

Thus, in FIG. 28 it will be observed that the pickup pin 120 in groove 122 has moved forwardly and the slide bar 118 is thus released and is moved by the spring 178 into a position in which the shoulder pin 176 has started to move into the high portion of the cam groove 175. FIG. 28 also illustrates the step of moving an anchor barb A into a position to engage the trim blade 158, shown diagrammatically, and in FIG. 29 the anchor barb is shown extended with the trim blade having cut off a projecting end A1.

FIG. 29 also illustrates the movement of the slide bar 118 forwardly a further distance so that the shoulder pin 176 is now located in the end of the cam groove 175L.

FIG. 29 also illustrates the movement of the slide bar 118 forwardly a further distance so that the shoulder pin 176 moves into the low end of the cam groove 175L. It is pointed out that shoulder pin 176, in thus moving into the low end 175L of the groove has dropped downwardly a distance sufficient so that the advance finger 168 may engage against an under side of an anchor clip A.

Figure 32:
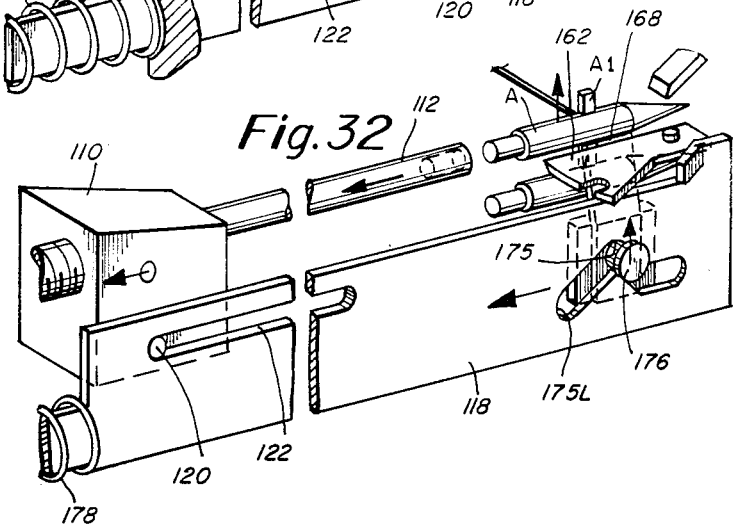
FIG. 32 is a view similar to FIG. 31 but showing the slide bar partly retracted and the shoulder pin in a high position in the slide bar groove.
Figure 33:
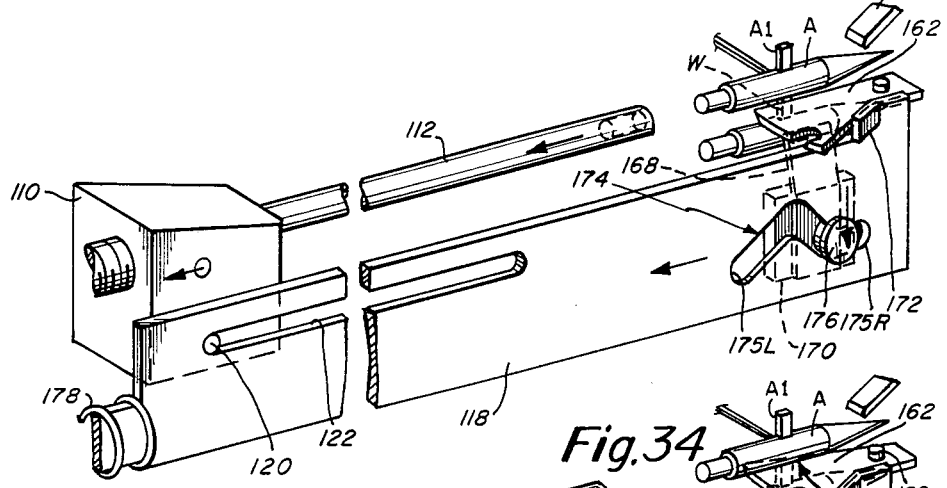
FIGS. 33 and 34 illustrate further steps in the sequence of operation of the injector gun.
Figure 34:
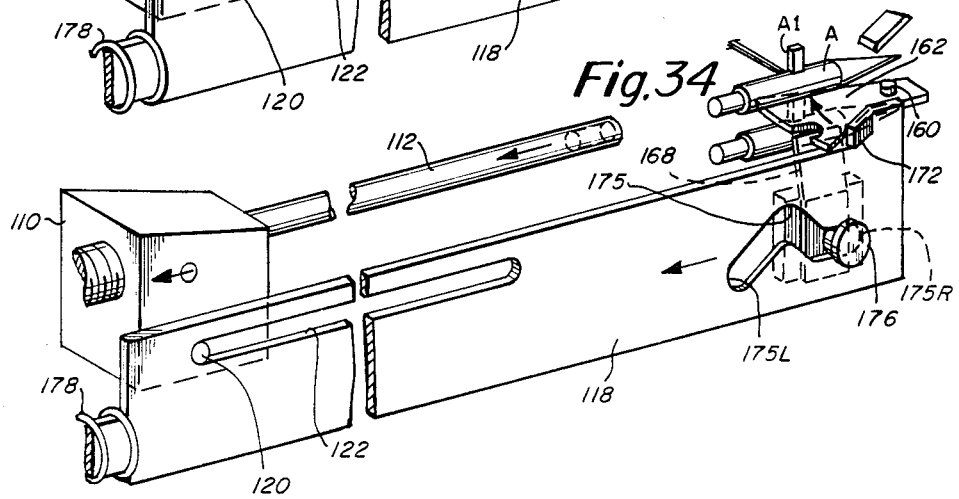
Figure 35:
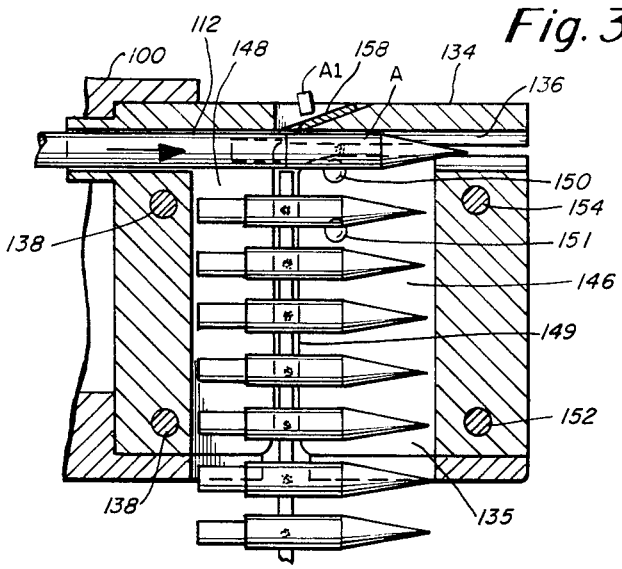
FIGS. 35, 36 and 37 are sequence views illustrating injection of an anchor barb into a covering material.
Figure 36:
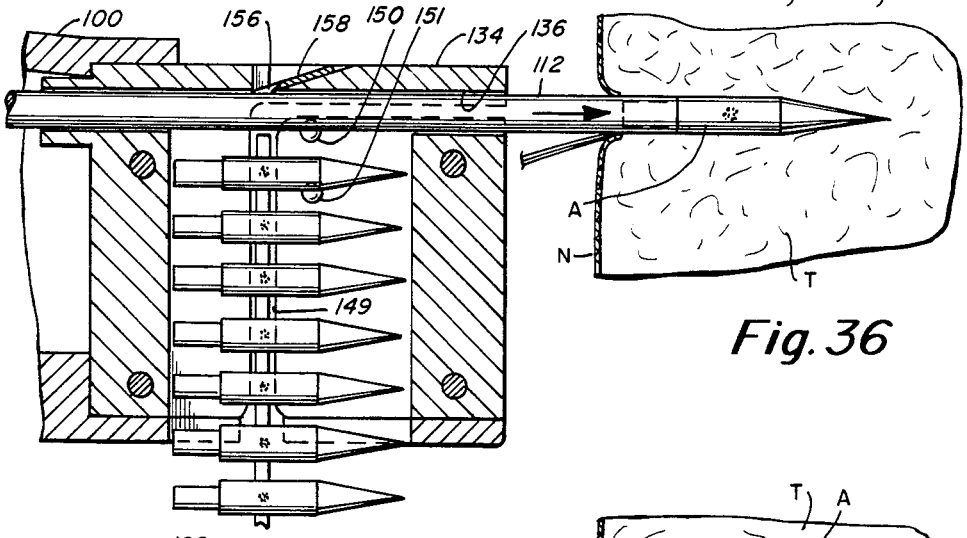
Figure 37:
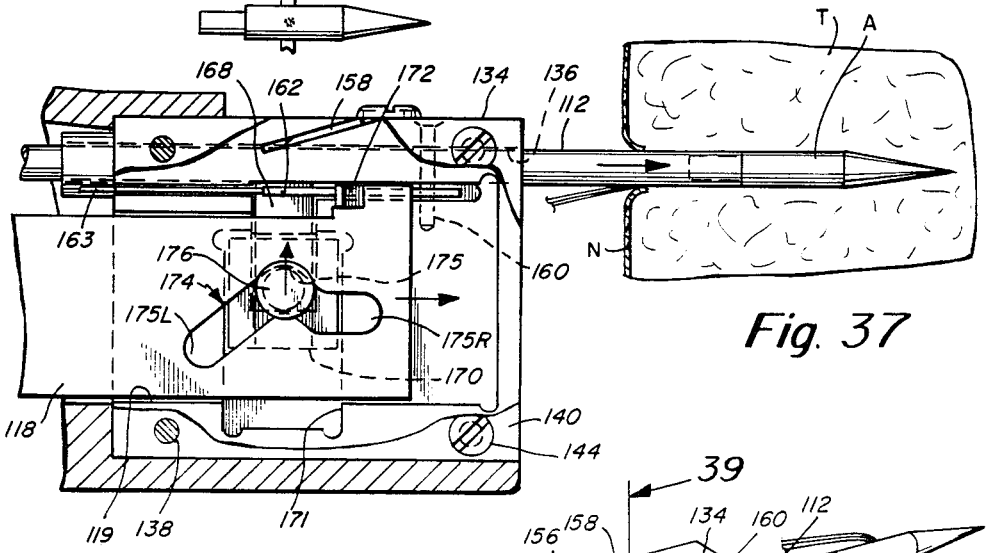

When the air cylinder trigger 104 is released the injector rod and carrier block start to retract. As this occurs the slide bar is engaged by the pickup pin compressing the slide bar against the coiled spring 178 and the shoulder pin 176 moves up to the high position 175 of the cam groove and simultaneously the advance finger 168 moves an anchor barb into the barrel. Almost instantly, however, the shoulder pin starts downwardly, as shown in FIGS. 32, 33 and 34 and the advance finger is moved back out of the way of the cutting blade 162 which is forced inwardly by the cam portion 172 cutting off a connecting web and leaving the anchor barb A ready to be again urged forwardly and injected into a covering material.

The injector gun is thus placed in readiness to begin another cycle of operation.

In FIGS. 44 and 45 there is illustrated an injector mechanism for dual injector heads as 200 and 202. These injector heads are operated by a pair of air cylinders 204 and 206 controlled by a trigger 208. It will be observed that the two injector heads are arranged in angularly disposed relationship so that they may apply anchor barbs and filament bundles to either side of a teddy bear T. In FIG. 45 the injector is shown with anchor barb clips 210 and 212 being introduced into the mechanism.

We claim:

1. A fabricated filament construction for attachment to a cover material including textile bodies, said fabricated filament construction comprising a plurality of flexible filaments secured together at one end by a midportion of an elongated anchor barb means, the anchor barb means being of a size and shape and oriented relative to the filaments such that it is adapted to be pressed through textile cover material and thereafter assume a position substantially normal to the filaments.

2. The filament construction of claim 1 in which the flexible filaments are arranged in bundles and the bundles are connected together in spaced apart relation by web portions connecting a plurality of said anchor barb means in parallel relation to provide a web clip of filament bundles.

3. the filament construction of claim 2 in which the anchor barb means have pointed ends, said anchor barb means being disposed at right angles to respective secured bundles.

4. Fabricated animal whisker construction for toy animals comprising flexible plastic filaments secured together at one end solely by a midportion of an elongated molded anchor barb means which extends away from the secured ends of the filaments generally normal thereto in opposite directions.

5. The whisker construction of claim 4 in which the molded anchor barb means have pointed end portions.

6. The whisker construction of claim 5 in which the molded anchor barb means are cylindrical and extend away from opposite sides of the secured ends of the filaments at right angles thereto.

7. The whisker construction of claim 6 in which the cylindrical anchor barb means is formed with a reduced cylindrical end part.

8. As an article of manufacture a fabricated animal whisker construction comprising a bundle of flexible plastic filaments of one end of said filaments having molded therearound plastic anchor barb means arranged in substantially right angularly disposed relation to the filaments and comprising a cylindrical body having a pointed end portion and an opposite end portion of reduced diameter.

9. The whisker construction of claim 4 in which the plastic filaments are arranged at one end in a plurality of bundles connected together in spaced apart relation by molded web portions which are formed integrally with the molded anchoring means and connecting a plurality of said anchor barb means in parallel relation.

10. Fabricated animal whisker construction for toy animals comprising flexible plastic filaments arranged in a plurality of bundles, said plastic filaments being of uniform length, the filaments in each bundle being secured together at one end by molded anchor barbs, said anchor barbs being connected together by web portions which are formed integrally with the molded anchor barbs, said anchor barbs extending away from the secured end of the filaments substantially at right angles and said anchor barbs being arranged in spaced apart parallel relationship to one another to constitute a web clip of anchor barbs and filament bundles.

* * * * *